United States Patent [19]

Kubeczka

[11] 4,313,714

[45] Feb. 2, 1982

[54] HIGH PRESSURE RADIAL PUMP

[76] Inventor: Johnny D. Kubeczka, 6002 Viking, Houston, Tex. 77092

[21] Appl. No.: 80,933

[22] Filed: Oct. 1, 1979

[51] Int. Cl.[3] ..... F04B 1/18

[52] U.S. Cl. ..... 417/273

[58] Field of Search ..... 417/273, 271

[56] References Cited

U.S. PATENT DOCUMENTS

| | | | |
|---|---|---|---|
| 2,058,591 | 10/1936 | Kammer | 417/271 |
| 3,924,968 | 12/1975 | Gaines et al. | 417/273 |
| 4,035,097 | 7/1977 | Bachand | 403/353 |

FOREIGN PATENT DOCUMENTS

| | | | |
|---|---|---|---|
| 1191147 | 10/1959 | France | 417/273 |
| 132469 | 9/1919 | United Kingdom | 417/273 |
| 1487311 | 9/1977 | United Kingdom | 417/273 |
| 261174 | 5/1970 | U.S.S.R. | 417/273 |

*Primary Examiner*—William L. Freeh

*Attorney, Agent, or Firm*—Neal J. Mosely

[57] ABSTRACT

A high pressure radial pump is disclosed for delivering a stream of water or other liquid at high velocity for jet washing or cleaning of various surfaces. The pump includes a plurality of radially extending cylinders (preferably five cylinders) connected together by an inlet manifold for admission of liquid and an outlet manifold for discharge of liquid. Each cylinder has a piston movable therein to draw in and discharge liquid at high pressure. The pistons are each provided with high pressure seals. The pistons are each connected to a centrally located ring connector driven by a rotary eccentric cam.

5 Claims, 3 Drawing Figures fig. 1
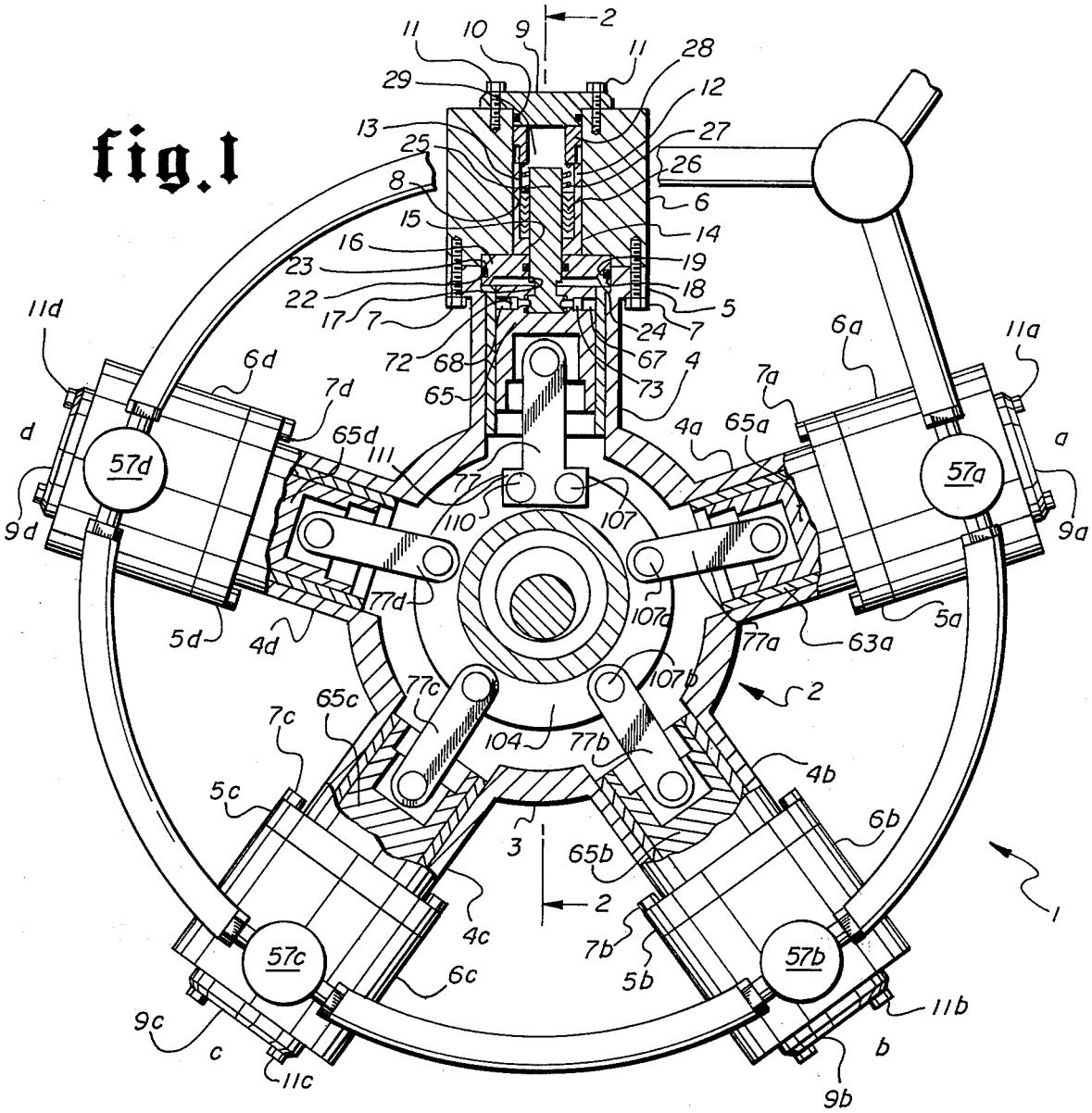
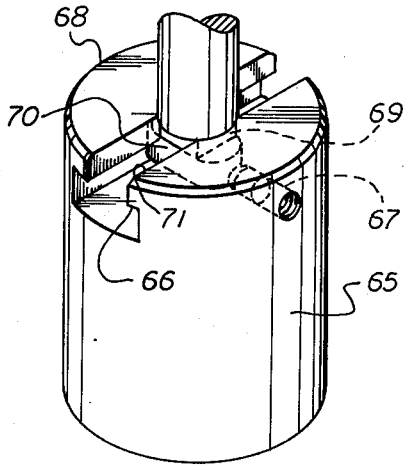
fig. 3

HIGH PRESSURE RADIAL PUMP

BACKGROUND OF THE INVENTION

1. Field of the Invention

This invention relates to new and useful improvements for liquid pumps and more particularly, to high pressure pumps for delivering a stream of water or other liquid at high velocity for jet washing or cleaning of surfaces.

2. Brief Description of the Prior Art

Sergeant U.S. Pat. No. 745,298 discloses a compressor having a series of pistons of varying diameter for compressing gasses.

Hoerbiger U.S. Pat. No. 1,759,617 discloses a gas compressor with a pair of line cylinders of different diameter and a larger and smaller piston for compression.

Wineman U.S. Pat. No. 2,365,234 discloses a pump having two different cylinders of varying diameter in line and a single piston fitting both the larger and smaller cylinders for delivering liquid and gasses to a common system.

Green U.S. Pat. No. 3,155,041 discloses a pressure apparatus comprising a pump having two or more cylinders of varying diameter and pistons fitting said cylinders and operated by a single pump rod.

There has been a need for a satisfactory high-pressure pump for delivering water or other liquid at very high velocity for jet washing or cleaning of various surfaces.

STATEMENT OF OBJECTS

One of the objects of this invention is to provide a new and improved high-pressure radial pump capable of delivering a stream of water or other liquid at a uniform high pressure and high velocity for jet washing or cleaning various surfaces.

Another object of this invention is to provide a new and improved high pressure radial pump including a plurality of radially extending cylinders connected together by manifolds for receiving and discharging liquid under uniform high pressure and at high velocity.

Still another object of this invention is to provide a new and improved high pressure radial pump having a plurality of cylinders and a plurality of pistons arranged to be alternately actuated to supply liquid at a uniform high pressure and high velocity.

Still another object of this invention is to provide a new and improved high pressure radial pump having a plurality of radially extending cylinders and pistons movable therein and actuated by a rotary drive mechanism.

Still another object of this invention is to provide a new and improved radial pump having a plurality of radially extending cylinders and pistons movable therein and arranged for actuation by a rotary eccentric drive mechanism.

Other objects of this invention will become apparent from time to time throughout the specification and claims as hereinafter related.

SUMMARY OF THE INVENTION

A high pressure radial pump achieving the aforementioned objectives is described herein.

A high pressure radial pump is disclosed for delivering a stream of water or other liquid at a high velocity for jet washing or cleaning of various surfaces. The pump includes a plurality of radially extending cylinders (preferably five cylinders) connected together by an inlet manifold for admission of liquid and an outlet manifold for discharge of liquid. Each cylinder has a piston movable therein to draw in and discharge liquid at high pressure. The pistons are each provided with high pressure seals. The pistons are each connected to a centrally located ring connector driven by a rotary eccentric cam.

BRIEF DESCRIPTION OF THE DRAWINGS

FIG. 1 is a plan view, partially in broken section, of a high pressure radial pump comprising a preferred embodiment of this invention.

FIG. 3 is an isometric view of one end of the drive cylinder or cup and showing the T-slot connection to the pump piston.

DESCRIPTION OF THE PREFERRED EMBODIMENT

Figure 2:
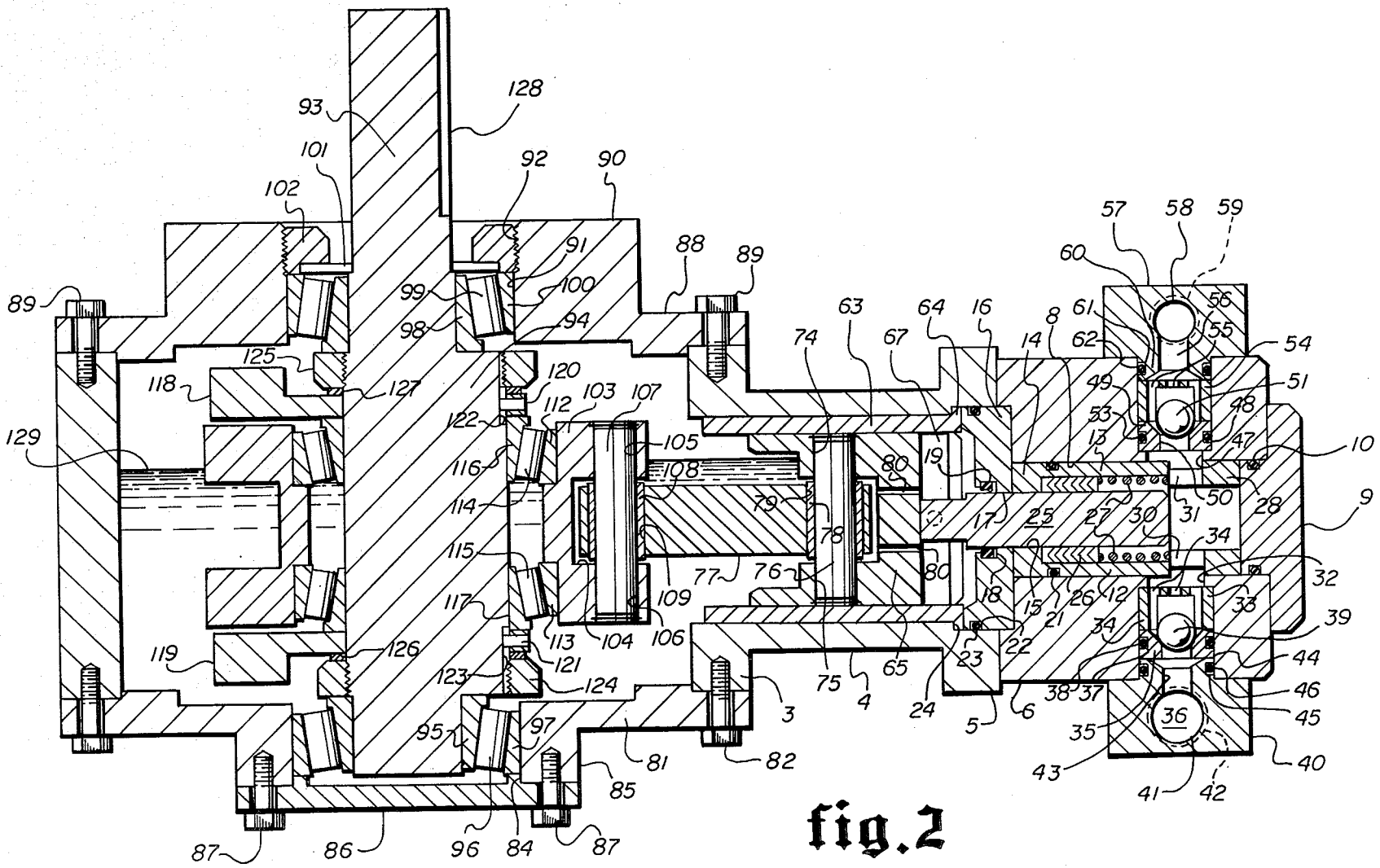
FIG. 2 is a sectional view taken on the line 2—2 of FIG. 1 and slightly enlarged in relation to the scale of the drawing shown in FIG. 1.

Referring to the drawings by numerals of reference and particularly, to FIGS. 1 and 2, there is shown a high-pressure radial pump 1 comprising a central housing 2. Housing 2 comprises the cylindrical housing portion 3, which is open on either side prior to assembly, having five radially extending portions or guide cylinders 4, **4*a*, 4*b*, 4*c*, and 4*d***, respectively. The pump can be operated with three or more cylinders, although a larger number of cylinders is preferred and it is also preferred to use an odd number of cylinders.

Guide cylinder 4 has a flange 5 on its outer end portion on which there is positioned a massive pump housing block member 6. Block member 6 is secured on flange 5 by a plurality of machine screws 7. Block member 6 is preferably a cylinder of stainless steel, or the like, and has an internal bore 8, extending through its entire length. The outer end of bore 8 is closed by a disc-shaped end plate 9 extending partially into bore 8 and sealed by O-ring 10. A plurality of machine screws 11 extend through end plate 9 into the end of block member 6 to secure disc plate member 9 tightly thereon in a high pressure fluid tight relation. Bore 8 has a bronze bearing member 12 positioned tightly therein and having a tubular extension 13 and a base or end wall portion 14 with a central opening 15 therein.

A disc shaped plate member 16 closes the inner end of block member 6 and has a central opening or passage 17 aligned with opening 15 in bearing member 12. End closure 16 has an inner groove 18 with an annular sealing washer 19 secured therein. Bearing member 12 has an outer peripheral groove with an O-ring 21 positioned therein to seal against fluid leakage between the outer surface of the bearing member and the surface or bore 8. End plate member 16, likewise, is provided with a peripheral groove 22 and O-ring 23 securing the outer surface thereof against fluid leakage. Disc-shaped end wall member 16 fits into a counter bore 24 in end flange 5. A pump piston member 25 extends through end wall member 16 and the central opening 15 of bearing member 12 into the interior of bore 8 in block member 6.

Piston member 25 extending into bore 8 is surrounded by chevron packing or seals 26 positioned within tubular extension 13 and held under compression by spring 27. A tubular retaining member 28 is positioned in bore 8 and abuts the disc-shaped end closure 9 at one end and at the other end abuts the end of tubular extension 13 and also secures the end of spring 27 which provides for compression of chevron seals 26. Tubular member 28 and the interior of tubular extension 13 define a fluid cylindrical pumping cavity 29. Tubular member 28 has an inlet aperture 30 and an outlet aperture 31.

On the inlet side of block member 6, there is provided an aperture 32 open to inlet aperture 30 in tubular member 28. Block member 6 has a counter bore 33 which opens into aperture 32. A valve cage 34 is positioned in counter bore 33 and includes a plurality of apertures 34 open to aperture 32. An annular valve seat member 35 is positioned in counter bore 33 against the end of valve cage 34, and has a central valve opening 36. Valve seat member 35 also has a peripheral groove 37 which is sealed by O-ring 38 against leakage. Valve cage 34 is preferably of aluminum. Valve seat member 35 is preferably made of stainless steel for strength and resistance to wear and for providing a tight valve closure. Valve member 39 is a spherical ball, preferably of stainless steel, which seats against valve seat member 35 during the discharge stroke of piston 25. A coupling member 40 is a cylindrical shape and has threaded openings 41 and 42 for connection to intake manifold conduits. Openings 41 and 42 extend together to form a passage which communicates through a side passage 43 with the interior aperture or opening 36 of valve seat member 35. Coupling member 40 has a cylindrical extension 44, which fits inside bore 33 and has a peripheral groove 45 with O-ring 46 secured therein to seal the coupling against leakage of high pressure fluid. Coupling member 40 may be secured in counter bore 33 by threaded connection or by machine screws or the like (not shown) as used for assembling other portions of the pump.

On the outlet side of block 6 there is provided an outlet aperture or opening 47 and a counter bore 48 open thereto. An annular valve seat member 49 is positioned in counter bore 48 and has a central opening 50 opened to outlet opening 31 in tubular member 28. A stainless steel spherical valve member 51 is movable relative to valve seat member 49 and is held in the seated position during the intake stroke of piston 25 and moved to an open position during the discharge stroke. Valve seat member 49 has a peripheral groove 52 with an O-ring 53 positioned therein to provide a fluid tight seal. Hollow valve cage 54 is positioned in counter bore 48 against valve seat member 49 and has openings 55 which open into the outlet aperture 56 of coupling member 57. Coupling member 57 is constructed substantially identical to coupling member 40 and has threaded opening 58 and 59 which form a passage therethrough into which aperture 56 opens. Valve seat member 49 and valve cage member 54 are preferably formed of stainless steel and aluminum, respectively. Coupling 57 is provided with tubular extension 60 having a peripheral groove 61 and O-ring 62 sealing bore 48 against leakage of high pressure fluid. Threaded openings 58 and 59 in coupling member 57 are secured to outlet manifold tubing, as will be subsequently described. Coupling member 57 is secured to block 6 by threaded connection (not shown) or by machine screws in manner similar to coupling member 40, described above.

Cylindrical portion 4 of housing 2 is provided with a tubular guide sleeve or bea ing member 62, preferably of bearing bronze for strength and wear characteristics. Guide sleeve or bearing member 63 has a flange 64 at its upper end which is held in place by closure member 16. A hollow cross head drive piston 65 is positioned in sleeve or bearing member 63 for longitudinal movement therein. Piston member 65 is secured to pump piston 25 by a T-slot arrangement shown in more detail in FIGS. 1 and 3. The upper end of piston 65 has a T-slot 66 formed therein and has a pair of passages 67 and 68 extending at right angles thereto. Pump piston 65 is provided with a peripheral groove 69 at its lower end and has edge flats 70 cut therein to define an end locking piece having a width slightly less than the width of the opening 71 to T-slot 66. The width of the lower part of T-slot 66 is slightly larger than the diameter of the lower end of piston member 25 to permit rotation of the same. When piston member 25 is assembled to operating piston member 65, the lower end portion is inserted into T-slot 66 and rotated 90° to secure pump piston 25 against separation in a longitudinal direction. Pins 72 and 73 are inserted in apertures 67 and 68 and abut indentations in the end portion of pump piston 25 to prevent the same from rotating to a position permitting disassembly after the operating piston and pump piston had been assembled for operation. Longitudinal movement of operating piston 65 in guide sleeve or bearing 63 effects longitudinal movement of pump piston 25 in pump cylinder 29 to admit liquid from the inlet manifold and discharge the same to the outlet manifold under pressure. Cross head piston 65 has a pair of aligned passages 74 and 75 in which there is positioned pivot pin 76 for connecting rod 77. Pivot pin 76 extends through bearing sleeve 78 which is positioned in aperture 79 at the upper end of connecting rod 77. The lower end of connecting rod 77 is connected to the drive mechanism which will be described more fully hereinafter.

The pumping arrangement of cylinder block 6, cylindrical housing portion 4, pump piston 25 and cross head piston 65 and the apparatus associated therewith, which has been just described, is repeated identically for each of the cylindrical extensions of housing 2 which are spaced radially around this radial pump assembly. The complete structure is shown only for one of the radial cylinder and piston assemblies and is shown only partially for the others. The portions of the other assemblies which are shown are given the same reference numerals with the superscript a, b, c or d, respectively, to identify a particular pump cylinder and piston assembly.

The central portion of the housing 2 enclosed within the cylindrical hub or housing 3 contains the operating mechanism for the several cross head drive pistons 65 and pump pistons 25. One side of cylindrical housing portion 3 is closed by plate member 81 which is secured in place by a plurality of machine screws 82. Plate member 81 has a central opening 84 in a tubular hub portion 85 which is closed by plate member 86 secured in place by machine screws 87.

The other side of cylindrical housing portion 3 is closed by disc shaped plate member 88 which is secured in place by machine screws 89. Cover plate 88 has a hub portion 90 with a central aperture or passage 91 having a threaded portion 92. Aperture or passage 91 in cover 88 in aligned with and concentric with aperture 84 in plate member 81.

A drive shaft 93 extends through opening 91, across the interior of housing 2, and into opening 84 of cover member 81. Drive shaft 93 is of uniform small diameter at opposite ends and has an enlarged central portion 94 which is constructed as an eccentric drive mechanism.

One end of drive shaft 93 has an inner tapered roller bearing race 95 secured thereon and resting for rotary movement on roller bearings 96 which roll inside an outer bearing race 97 supported in opening 84.

At the other end of shaft 93 an inner tapered roller bearing race 98 is supported thereon. Roller bearings 99 ride on bearing race 98 and ride against outer bearing race 100 which is supported in opening 91. An automotive type shaft seal 101 surrounds shaft 93 and is secured against the end of stationary outer bearing race 100 by ring nut 102 which also abuts the stationary outer bearing race 100 and secures the same against lateral movement. Shaft seal 101 prevents leakage of oil from inside housing 2 during operation of the pump.

At the central part of the housing portion 3, there is positioned a ring shaped drive member 103 which has a peripheral groove 104 into which connecting rods 77, 77*a*, 77*b*, 77*c* and 77*d* extend. Ring shaped drive member 103 has aligned passages 105 and 106 through which extend connecting pin 107 which extends through bearing sleeve 108 in aperture 109 at the lower end of connecting rod 77. Connecting rod 77*a*, 77*b*, 77*c*, and 77*d* have a single pin 107*a*, 107*b*, 107*c*, or 107*d* connecting the same to ring member 103 and are free to pivot. Connecting rod 77, however, has a second connecting pin 110 which connects the T-shaped base 111 of that connecting rod to ring member 103 to prevent the same from pivoting. As will be described later, this construction is necessary to prevent ring member 103 from rotating during operation. On the inner surface of the ring member 103, there are positioned outer tapered roller bearing races 112 and 113 which ride on rollerbearings 114 and 115, respectively which in turn rest on inner roller bearing races 116 and 117. Bearing races 116 and 117 are supported on the cylindrically shaped eccentric portion 94 of drive shaft 93.

A pair of counter balance weight members 118 and 119 are supported on shaft 93 on the eccentric portion 94 thereof and are located by pins 120 and 121 which extend into grooves 122 and 123. Ring nuts 124 and 125 are threadedly supported on the ends of eccentric portion 94 and secure washers 126 and 127 against the supporting portion of counter balance weights 118 and 119 and also secure bearing races 116 and 117 in place.

The apparatus so far described, is normally operated with the drive shaft 93 extending vertically. The upper (or left) end of drive shaft 93 is provided with a groove or flat 128 machined therein to provide for connection of pulley or gear for connecting the pump to an external power source. The apparatus is filled with oil to a level of about three-fourths as indicated in FIG. 2. The oil 129 keeps the apparatus lubricated at all points and can pass through the passages or apertures 80 in the cross head piston 65 so that the end of the drive cylinder is lubricated at all times and the pump piston 25 is provided with external lubrication for reciprocal movement of that piston into and out of the pump cylinder cavity 29.

In FIG. 1, the pump is shown in a normal horizontal operating position with the drive shaft 93 extending upward. The couplings 57, 57*a*, 57*b*, 57*c* and 57*d* are outlet couplings and are connected by conduits 130 to each other and to coupling 131 which is a Y-coupling having an outlet conduit 132 for discharge of fluid under pressure. On the outer side of the pump as shown in FIG. 1, the couplings 40, 40*a*, 40*b*, 40*c* and 40*d* are connected by conduits 133 to each other and to a Y-coupling 134 having an inlet conduit 135 connected thereto.

OPERATION

The operation of this rotary radial pump should be apparent from the description of the construction and assembly thereof, but will be described in more detail for clarification.

The pump is assembled, as described above, and is filled with oil to the desired level just prior to installing shaft seal 101 and ring nut 102 in place. It should be kept in mind that the equipment is normally operated with a drive shaft 93 extending upward. In this position, the oil 129 would be filled to about the level shown in FIG. 2. Plate member 86, which is at the bottom of the pump during normal operation, may be removed for draining the drive chamber to replace it with fresh oil. If desired, plate member 86 could be made to be integral with cover 81 and some other form of drainage opening (such as a drain plug) could be provided.

As drive shaft 93 is rotated, eccentric portion 94 rotates and causes ring member 103 to oscillate and move connecting rods 77, 77*a*, 77*b*, 77*c* and 77*d* sequentially inward and outward of their respective cylinders 4, 4*a*, 4*b*, 4*c* and 4*d*, thus, reciprocating cross head pistons 65, 65*a*, 65*b*, 65*c* and 65*d* in sequence. As previously noted, connecting rod 77 has a non-pivoting connection to ring member 103 by means of pins 107 and 110. This prevents the ring member 103 from rotating about the shaft 93 and the eccentric drive portion 94 thereof. The arrangement of eccentric 94 and tapered bearings associated therewith causes ring member 103 to oscillate and move connecting rods 77, 77*a*, 77*b*, 77*c* and 77*d* sequentially. This effects a sequential movement of cross head pistons 65 65*a*, 65*b*, 65*c*, and 65*d* and the pump pistons 25, 25*a*, 25*b*, 25*c*, and 25*d* secured thereon.

In the view shown in FIG. 1, pump piston 25 is shown in its position of maximum extension into pump chamber 29. Pump pistons 25*b*, and 25*c* would be shown at the point of maximum withdrawal if the apparatus were completely shown in section and pump pistons 25*a* and 25*b* are in an intermediate position. As eccentric 94 rotates within ring member 103, piston 25 will move inward and the succeeding pistons around the apparatus will move either inwardly or outwardly according to the point of connection. As piston 25 moves inwardly, it is on an intake stroke and liquid will enter pump chamber past valve 39 while valve 51 will be seated against valve seat member 49. When one of the pump pistons 25 (or 25*a* 25*b*, 25*c* or 25*d*) is on a compression stroke, moving outwardly, valve 39 is seated against valve seat member 35 and valve 51 is moved away from valve seat 49 to permit liquid under pressure to flow outward. Liquid enters the pump through inlet conduit 135 and Y coupling 134 and is connected as a manifold through conduits 133 leading to couplings 40 40*a*, 40*b*, 40*c* and 40*d*, respectively. On the compression stroke of each of the pistons, liquid under pressure flows out through couplings 57, 57*a*, 57*b*, 57*c* and 57*d* and a manifold comprising conduits 130 which connect those couplings together and connect them to the outlet or discharge Y coupling and to outlet conduit 132 which discharges the liquid under very high pressure for jet washing or cleaning of various surfaces.

This apparatus when operated, as just described, is capable of delivering liquid at very high pressure for jet washing. The apparatus is self-lubricating and is easy to assemble and disassemble for servicing. The counterbalance weights 118 and 119 counter balance the eccentric drive portion 94 exactly and prevent the apparatus from vibrating during use. The individual pump cylinder block may be serviced easily during operation. The cover plate 9 9*a*, 9*b*, 9*c* and 9*d* are easy to remove and pump pistons 25, 25*a*, 25*b*, 25*c* and 25*d* may be individually removed for servicing by turning the piston one quarter turn for removing the same from the key slot connection. The bearing member 14 and chevron seal may also be removed for service and replacement of the seal. The construction of this rotary pump makes it also easy to change the size of the pump piston and pumping cylinder block. If desired, the pump piston and the entire cylinder block may be removed and a cylinder block substituted having a larger internal bore and a larger piston for increasing the capacity of the pump.

This pump provides for a uniform delivery of liquid at very high pressure and without pulsations in pressure. As noted above, the number of pump cylinders in this radial pump construction can be varied, if desired. This type of pump is difficult to operate with an even number of cylinders and, particularly, with only two cylinders. It is preferred to use five cylinders although a pump with three cylinders, or seven or nine or more would be operative.

While this invention has been described fully and completely with emphasis upon a single preferred embodiment, it should be understood that within the scope of the appended claims, this invention may be practiced otherwise than as specifically described herein.

I claim:

1. A high pressure rotary pump comprising housing means including a central chamber portion comprising a fluid-tight chamber substantially filled with lubricating oil and a plurality of hollow portions extending radially outward therefrom, said radially extending portions each including means forming a pumping cylinder having an inlet and an outlet for pumping liquid therethrough, a plurality of pump piston means, each comprising a cross head drive portion and a separate pump piston removably secured thereon guided in one of said hollow portions and extending into one of said pumping cylinders, said cross head pistons each having a T-slot therein, said pump pistons each being a rod with a slotted end portion of a size and shape removably secured to said cross head piston by insertion in said T-slot in one direction followed by 90° rotation thereof, said cross head pistons each having apertures permitting flow of oil through the end wall thereof, said pumping cylinders each including sealing means surrounding the respective pump pistons to seal against lubricating oil entering therein, a first conduit means interconnecting said inlets for conducting fluid thereto, a second conduit means interconnecting said outlets for conducting fluid therefrom, rotary operating means comprising a rotary drive shaft extending into said fluid-tight chamber and having a cylindrically shaped offset cam portion and a ring member surrounding the same for operation thereby supported for rotation in said chamber, connecting means comprising a plurality of connecting rod members each connected at one end to said ring member and at the other end to one of said pump piston means for moving the same reciprocally and sequentially into and out of said hollow portions and said pumping cylinders, one of said connecting rod members being connected to said ring member by a non-pivotal connection, all of the other connecting rod members being connected to said ring member by pivotal connections, and all of said connecting rods being connected to respective ones of said cross head drive pistons by pivotal connections.

2. A radial pump according to claim 1 in which said pumping cylinders each have a removable cover permitting access to said pump pistons for removal of the same by 90° rotation for replacement and for servicing without removing the cylinder.

3. A radial pump according to claim 2 in which said sealing means comprises chevron seals surrounding each pump piston in each respective pumping cylinder and helical springs holding said seals under compression.

4. A radial pump according to claim 1 including counterbalance weights supported on said shaft opposite said offset cam portion and positioned and sized to prevent vibration upon rotation thereof, said central chamber including roller bearings supporting said shaft, roller bearings supported on said offset cam portion and supporting said ring member, one of said connecting rod members being connected to said ring member by a non-pivotal connection, all of the other connecting rod members being connected to said ring member by pivotal connections, and all of said connecting rods being connected to respective ones of said cross head drive pistons by pivotal connections.

5. A radial pump according to claim 4 in which said pumping cylinders each have a removable cover permitting access to said pump pistons for removal of the same by 90° rotation for replacement and for servicing.

* * * * *